US008490424B2

(12) United States Patent
Roche et al.

(10) Patent No.: US 8,490,424 B2
(45) Date of Patent: Jul. 23, 2013

(54) LED CANOPY LIGHT FIXTURE

(75) Inventors: John M. Roche, Ballwin, MO (US); Sesha C. Madireddi, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 2148 days.

(21) Appl. No.: 11/324,081

(22) Filed: Dec. 30, 2005

(65) Prior Publication Data

US 2007/0151274 A1 Jul. 5, 2007

(51) Int. Cl.
*F25D 23/00* (2006.01)

(52) U.S. Cl.
USPC ..... 62/264; 62/246

(58) Field of Classification Search
USPC ..... 62/246–256, 264; 362/800, 92, 125; 312/223.5
See application file for complete search history.

(56) References Cited

U.S. PATENT DOCUMENTS 2,490,413 A * 12/1949 Burtis ..... 62/249
2,495,554 A * 1/1950 Spangler ..... 62/252
2,584,494 A * 2/1952 Olson ..... 62/249
2,655,419 A * 10/1953 Achs ..... 312/227
5,508,898 A * 4/1996 McGovern ..... 362/92
6,550,269 B2 4/2003 Rudick
6,558,017 B1 * 5/2003 Saraiji et al. ..... 362/125
6,827,463 B2 * 12/2004 Chuang et al. ..... 362/92
7,036,947 B2 * 5/2006 Chuang et al. ..... 362/92
7,240,506 B2 * 7/2007 Grassmuck et al. ..... 62/249
7,296,912 B2 * 11/2007 Beauchamp ..... 362/249

FOREIGN PATENT DOCUMENTS

DE 29717444 1/1998

* cited by examiner

*Primary Examiner* — Cheryl J Tyler
*Assistant Examiner* — Lakiya Rogers
(74) *Attorney, Agent, or Firm* — Michael Best & Friedrich LLP

(57) ABSTRACT

A refrigerated display case for maintaining food product at a desired temperature includes a product display area adapted to support and to display the food product such that the food product is accessible from the front of the case through an opening. An interior top wall is positioned above the product display area and includes an outlet adjacent the opening. An air passageway internal to the case and in fluid communication with the outlet permits refrigerated air from a refrigeration system to be supplied to the product display area through the outlet. The air discharged from the outlet defines an air curtain adapted to maintain the food product at the desired temperature. A light source is disposed adjacent the interior top wall and inside the air curtain and is adapted to illuminate the food product within the product display area.

10 Claims, 4 Drawing Sheets

LED CANOPY LIGHT FIXTURE

BACKGROUND

The present invention relates to a refrigerated display case that includes a light source. More particularly, the present invention relates to a refrigerated display case including a light emitting diode (LED) light source to illuminate a product display area.

In conventional practice, commercial businesses such as supermarkets and convenience stores are equipped with refrigerated display cases. These refrigerated display cases may be open or provided with doors and are used for presenting perishable food or beverages to customers while maintaining the fresh food or beverages in a refrigerated environment. Typically, these refrigerated display cases include a light source to illuminate the product display area for better marketing of the food product and for higher visibility to the customers.

FIG. 1 depicts a prior art refrigerated display case 10 utilizing a fluorescent light source 15 to illuminate a product display area 20. The refrigerated display case 10 includes an upper wall 25 having an outlet 30 providing refrigerated airflow in the form of an air curtain 35. The upper wall 25 includes an extended portion 40 that projects beyond the outlet 30 and outside the air curtain 35. The two fluorescent light sources 15 couple to the extended portion 40 and partially illuminate the product display area 20. Additional fluorescent light sources 15 are coupled to shelving units 45 to further illuminate food product in the product display area 20.

The effectiveness of the fluorescent light source 15 to illuminate the product display area 20 is dependent on the temperature of the application where the fluorescent light source 15 is used. In colder temperature conditions, the fluorescent light source 15 has less light output than in application of the fluorescent light source 15 in warmer temperature conditions. Thus, the fluorescent light source 15 is most effective when coupled to the refrigerated display case 10 outside the air curtain 35 as shown in FIG. 1. However, positioning the fluorescent light source 15 outside the air curtain 35 reduces its illuminating effect on the product display area 20. Also, the fluorescent light source 15 coupled to the shelving unit is positioned within the air curtain 35, which substantially reduces effective illumination of other food product within the product display area 20.

SUMMARY

The invention provides an improved refrigerated display case configured to illuminate a product display area effectively and efficiently. In one embodiment, the invention provides an improved light source that enables improved illumination of the product display area and reduces the energy required to refrigerate the products within the refrigerated display case.

In one embodiment, the invention provides a refrigerated display case for maintaining food product at a desired temperature. The case includes a product display area adapted to support and to display the food product such that the food product is accessible by consumers from the front of the case through an opening. An interior top wall of the case is positioned above the product display area and includes an outlet adjacent the opening at the front of the case. An air passageway internal to the case is in fluid communication with the outlet. The case also includes a refrigeration system for cooling air within the air passageway and supplying the refrigerated air to the product display area through the outlet. The air discharged from the outlet defines an air curtain adapted to maintain the food product at the desired temperature. A light source is disposed adjacent the interior top wall and inside the air curtain. The light source is adapted to illuminate the food product within the product display area.

In another embodiment, the refrigerated display case includes a light emitting diode (LED) light source adjacent the interior top wall and inside the air curtain. A honeycomb or louver is disposed across the outlet and the LED light source is positioned within a corner defined by the louver and the interior top wall.

In yet another embodiment, the refrigerated display case includes at least one shelving unit coupled to the case to support and to display some of the food product within the product display area. A light emitting diode (LED) light source is supported by the shelving unit and positioned adjacent an end of the shelving unit near the opening in the front of the case to illuminate other food product.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 2:
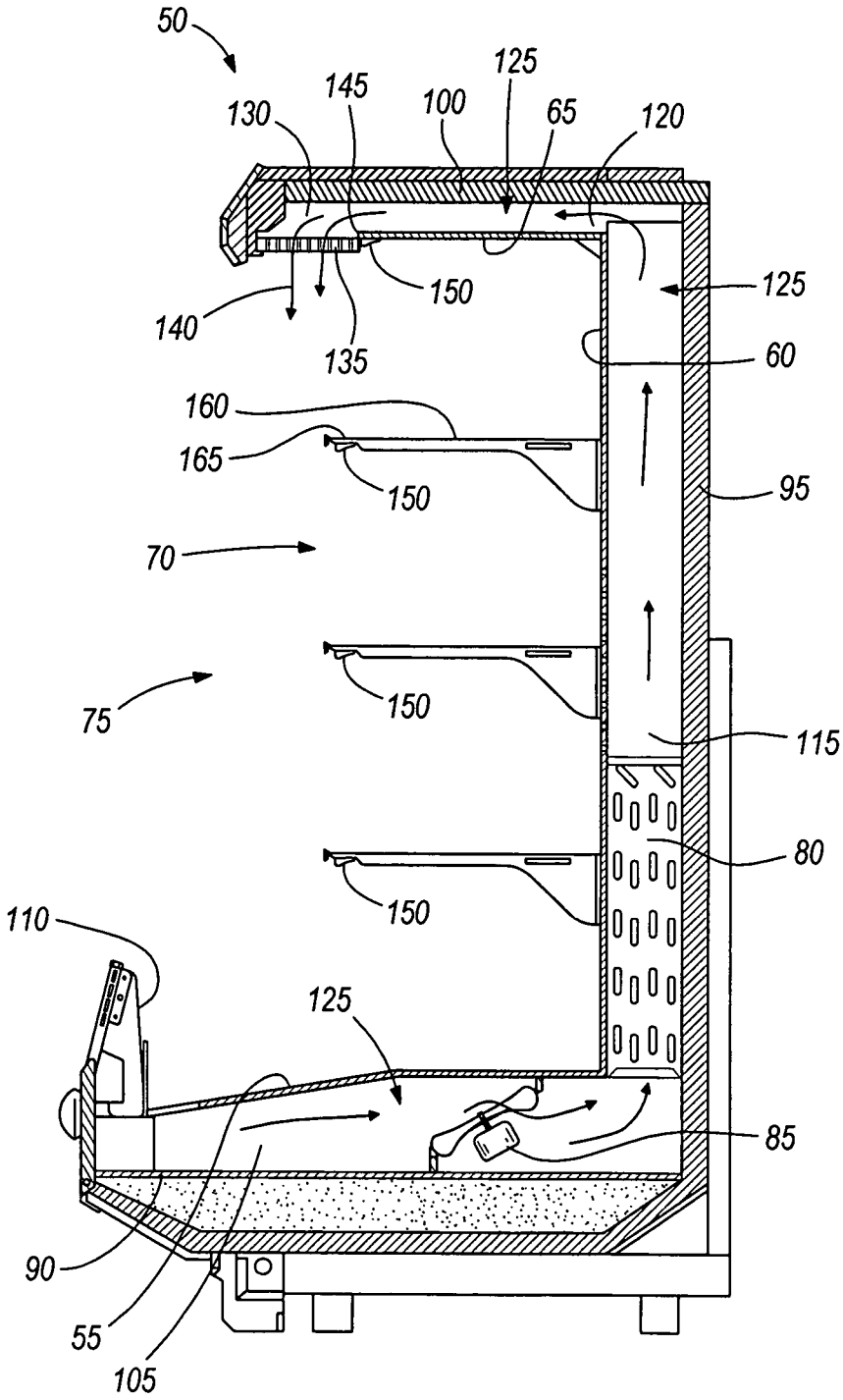
FIG. 2 is a side view of a multi-deck refrigerator display case including an LED light source to illuminate a product display area.

A refrigerated display case 50 is shown in FIG. 2 generally defining an interior bottom wall or shelf 55, an interior rear wall 60, and an interior top wall 65. The area bounded by the interior bottom shelf 55, the interior rear wall 60, and the interior top wall 65 defines a product display area 70, in which refrigerated products (e.g., fresh food and/or beverages) may be stored. An opening 75 near the front of the case 50 allows customers access to refrigerated products stored in the case.

The case 50 may include a medium temperature case, in which the air temperature in the product display area 70 is maintained within a standard temperature range of 32° F. to 41° F. Such cases may include, for example, meat cases, deli and dairy cases, and produce cases. Alternatively, the case 50 may comprise a low temperature case, in which the air temperature in the product display area 70 is maintained at a temperature below 32° F. Such a case may include, for example, a reach-in frozen food case.

The case 50 may be two interconnected modules (not shown). Each module may include a case having its own set of refrigeration components (e.g., an evaporator 80 and one or more fans 85). The separate modules may be interconnected by decorative or structural moldings to give the appearance of a single case. In addition, the separate modules may be interconnected to give the appearance of a single product display area 70. Alternatively, the case 50 may include a single module, or the case 50 may include more then two interconnected modules. For purposes of description only, a single case module is described herein.

The case 50 generally defines an exterior bottom wall 90 adjacent the interior bottom shelf 55, an exterior rear wall 95 adjacent the interior rear wall 60, and an exterior top wall 100 adjacent the interior top wall 65. A lower flue 105 is defined between the interior bottom shelf 55 and the exterior bottom wall 90 to allow for substantially horizontal airflow throughout the lower flue 105. The interior bottom shelf 55 includes an aperture 110 to communicate with the lower flue 105 to allow surrounding air to be drawn into the lower flue 105 from the product display area 70. A rear flue 115 is defined between the interior and exterior rear walls 60, 95 and is fluidly connected with the lower flue 105. The rear flue 115 allows for substantially vertical airflow throughout the rear flue 115. An upper flue 120 is defined between the interior and exterior top walls 65, 100 and is fluidly connected with the rear flue 115. The upper flue 120 allows for substantially horizontal airflow throughout the upper flue 120. The lower flue 105, the rear flue 115, and the upper flue 120 define an internal air passageway 125 separate from the product display area 70. The interior top wall 65 includes an outlet 130 in communication with the air passageway 125 to allow airflow to be discharged from the upper flue 120 and into the product display area 70. A louver 135 is disposed across the outlet 130 to project the discharged air in a predetermined flow pattern defining an air curtain 140. A portion of the louver 135 farthest from the opening 75 forms a corner 145 with the interior top wall 65 inside the air curtain 140.

The case 50 also includes some components of a refrigeration system (not entirely shown) therein. One or more fans 85 generate an airflow within the air passageway 125 and through the evaporator 80 to be cooled and may be positioned upstream or, alternatively, downstream of the evaporator 80. The evaporator 80 receives a liquid refrigerant from a receiver and the liquid refrigerant evaporates as it passes through the evaporator 80 as a result of absorbing heat from the air within the air passageway 125. Consequently, the temperature of the airflow within the air passageway 125 decreases as it passes over the evaporator 80. The refrigerated airflow then discharges through the outlet 130 and into the product display area 70. The refrigeration system may also include other components (not shown), such as one or more compressors, one or more condensers, a receiver, and one or more expansion valves.

The case 50 illustrated in FIG. 2 also includes a light source 150 coupled adjacent the interior top wall 65 to illuminate the product display area 70. The light source 150 is positioned within the corner 145 inside the air curtain 140 and is directed toward the product display area 70. Alternatively, the light source 150 may be positioned adjacent the interior rear wall 60 or other locations to effectively illuminate the product display area 70. The illustrated light source 150 includes light emitting diodes (LEDs) 155 (see FIGS. 3 and 4) inside the air curtain 140, although other light sources are considered (e.g., fluorescent or incandescent).

The case 50 shown in FIG. 2 includes shelving units 160 coupled to the interior rear wall 60 to support and to display additional food product. The shelving units 160 extend toward the opening 75 and within the product display area 70. Each shelving unit 160 includes a light source 150 adjacent an end portion 165 of the shelving unit 160 nearest the opening 75. The light source 150 is further disposed on the bottom of the end portion 165 to illuminate food product positioned below the shelving unit 160. Alternatively, the light source 150 coupled to the shelving unit 160 may be positioned above the end portion 165 or on the end of the shelving unit 160. The light source 150 considered in this embodiment includes LEDs 155, although other light sources are possible.

Figure 3:
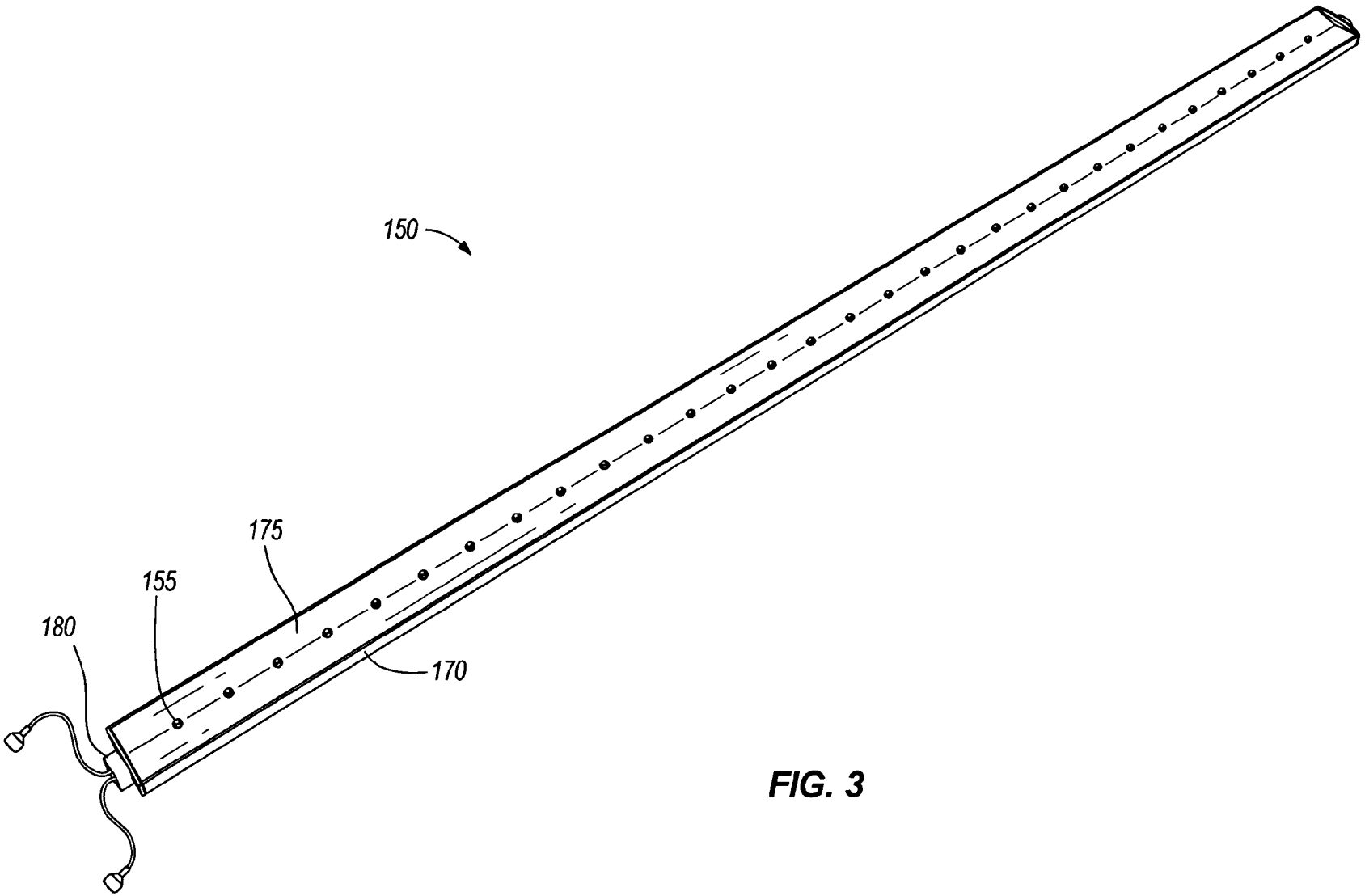
FIG. 3 is a perspective view of the LED light source of FIG. 2.
Figure 4:
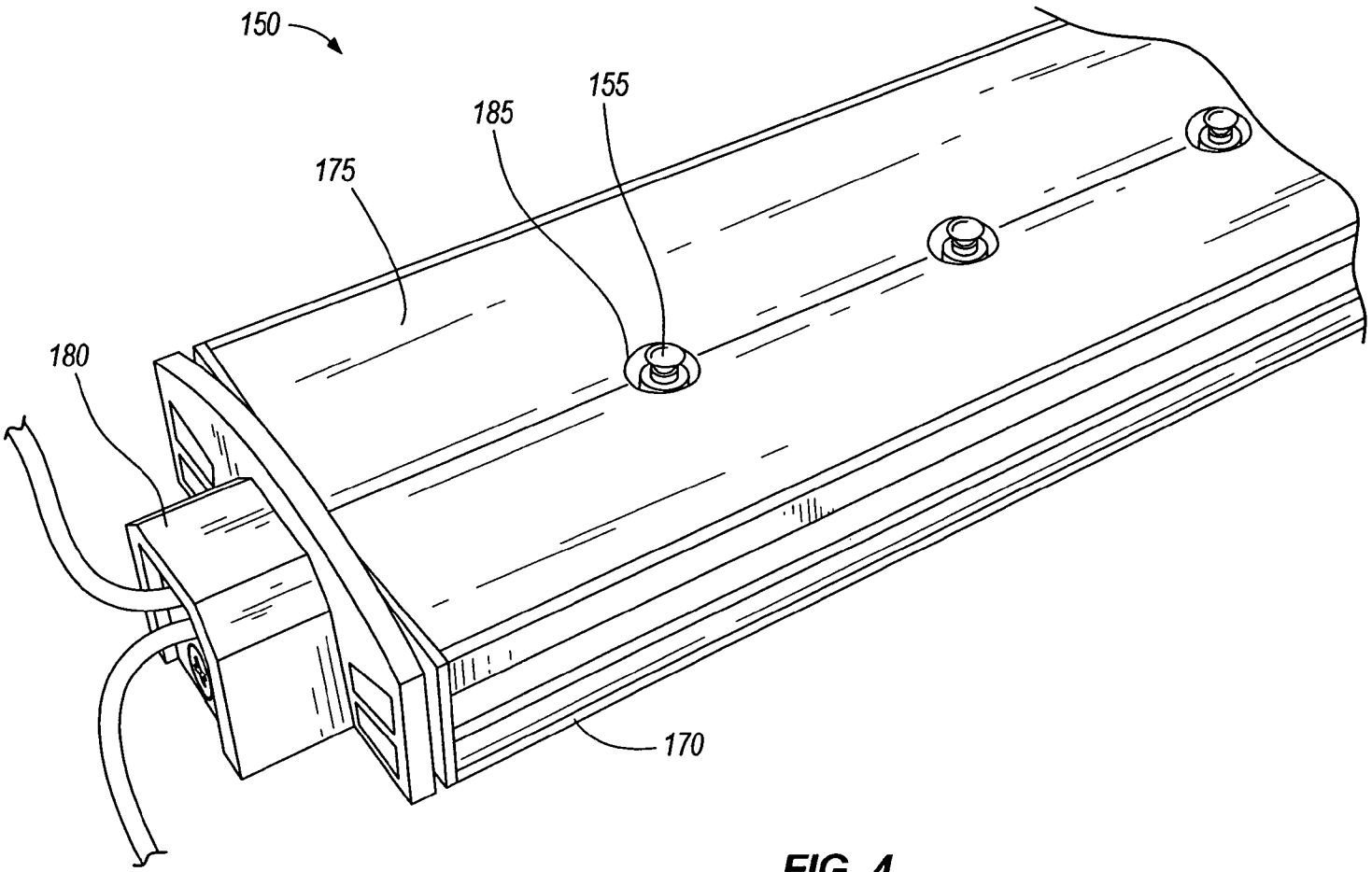
FIG. 4 is an enlarged perspective view of a portion of the LED light source of FIG. 3.

FIGS. 3 and 4 illustrate one embodiment of the light source 150 including LEDs 155, a casing 170, a cover 175, and an electrical connection 180. The LEDs 155 are supported by the casing 170 and are electrically coupled within the casing 170. The size of the casing 170 and the quantity of the LEDs 155 are determined by the requirements of the case 50. Holes 185 in the cover 175 allow the LEDs 155 to at least partially protrude through the cover 175. The cover 175 is made of a reflective material and is bent along its length to assist in directing the light provided by the LEDs 155. When the electrical connection 180 is coupled to a power supply (not shown), the LEDs 155 illuminate the product display area 70. Other embodiments of LEDs 155 coupled to the case 50 or to the shelving unit 155 are possible and considered herein.

Figure 1:
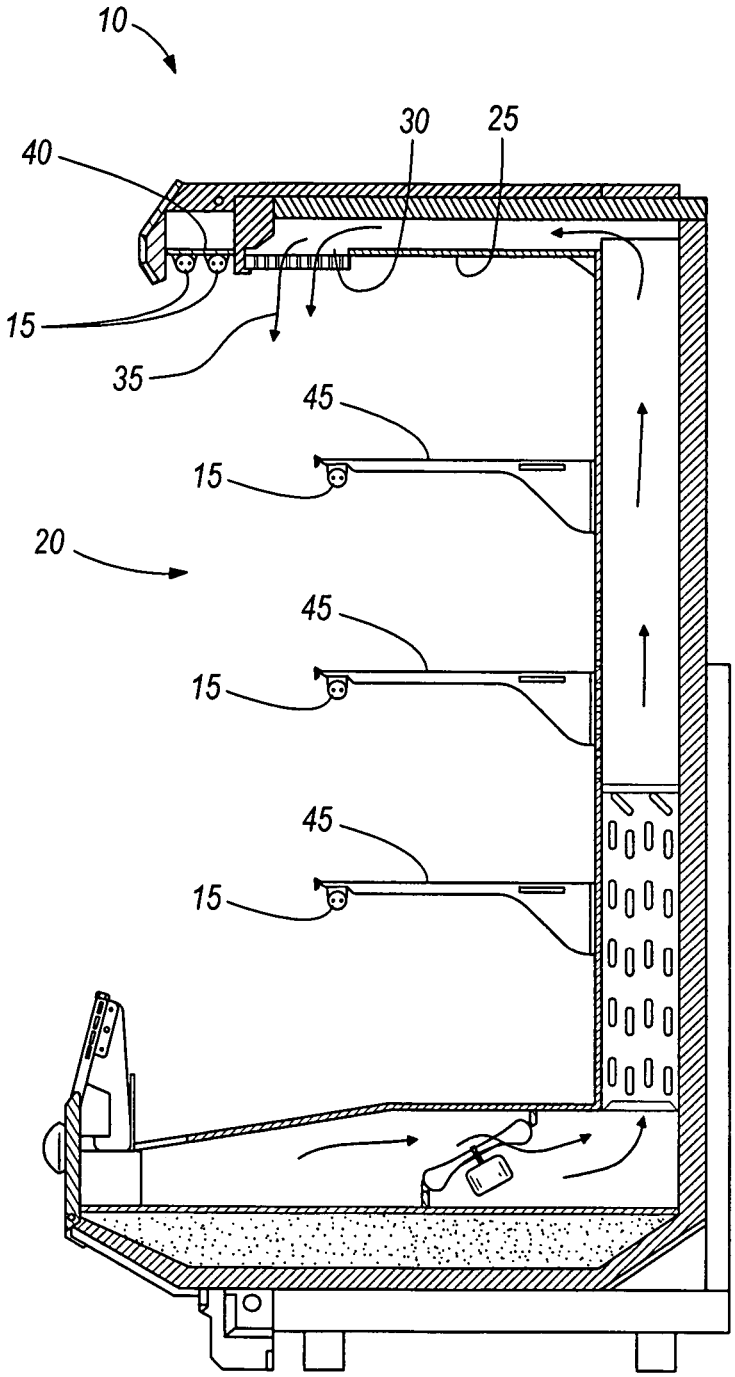
FIG. 1 PRIOR ART
FIG. 1 is a side view of a prior art, multi-deck refrigerator display case including a fluorescent light source to illuminate a product display area.

One embodiment of the light source 150 within the case 50 includes a 15-Watt LED source to illuminate the product display area 70. However, a light source 150 using LEDs 155 with different levels of power (Watts) are possible. In other embodiments, an LED light source within a range of 14-16 Watts may be used as the light source 150. In yet another embodiment, an LED light source less than 20 Watts may be used to illuminate the product display area 70. The location of the light source 150 adjacent the opening 75 and inside the air curtain 140 positions the light source 150 closer to the product and improves the illumination of the product display area 70. Although the light source 150 is positioned within the product display area 70, the use of the LEDs 155 provides substantial energy savings. For example, the 15-Watt LED source may be used to replace two 30-Watt fluorescent light sources 15 (see FIG. 1) and to provide a similar illumination of the product display area 70 as the two 30-Watt fluorescent light sources 15. The location of the 15-Watt LED source adds a small heat penalty within the product display area 70 and requires additional power input to the refrigeration system in order to maintain a desired temperature. However, the overall power required to illuminate and to refrigerate the case 50 using the 15-Watt LED source is lower than the power required by the case 10 of FIG. 1 using the 30-Watt fluorescent light source 15.

Thus, the invention provides, among other things, a refrigerated display case 50 that includes a product display area 70 illuminated by a light source 150 using LEDs 155 positioned inside an air curtain 140. Various features and advantages of the invention are set forth in the following claims.

We claim:

1. A refrigerated display case for maintaining food product at a desired temperature, the refrigerated display case comprising:

a product display area adapted to support and to display the food product such that the food product is accessible from the front of the case through an opening, an interior top wall positioned above the product display area, the interior top wall including an outlet adjacent the opening, and an air passageway internal to the case and in fluid communication with the outlet;

a refrigeration system for cooling air within the air passageway and supplying the refrigerated air to the product display area through the outlet, the air discharged from the outlet defining an air curtain adapted to maintain the food product at the desired temperature; and a light source disposed adjacent the interior top wall and interior of the air curtain, the light source positioned adjacent the opening and adapted to illuminate the food product within the product display area.

2. The refrigerated display case of claim 1, further comprising at least one shelving unit coupled to the case to support and to display some of the food product within the product display area, a light source supported by the shelving unit, wherein the light source illuminates other food product.

3. The refrigerated display case of claim 2, wherein the light source is a light emitting diode (LED).

4. The refrigerated display case of claim 3, wherein the LED light source is a 20-Watt or less light source.

5. The refrigerated display case of claim 3, wherein the LED light source is adjacent to an end of the shelving unit nearest an opening in the front of the case.

6. The refrigerated display case of claim 5, wherein the LED light source is positioned below the end of the shelving unit.

7. The refrigerated display case of claim 1, wherein the light source is a light emitting diode (LED) light source.

8. The refrigerated display case of claim 7, further comprising a louver disposed across the outlet.

9. The refrigerated display case of claim 8, wherein the louver and a bottom surface of the interior top wall form a corner, wherein the LED light source is positioned within the corner.

10. The refrigerated display case of claim 7, wherein the LED light source is a 20-Watt or less light source.

* * * * *